US009067710B2

(12) United States Patent
Orlowski

(10) Patent No.: US 9,067,710 B2
(45) Date of Patent: Jun. 30, 2015

(54) REMOTELY OPENABLE CONTAINMENT SYSTEM AND INSTALLATION METHOD

(71) Applicant: Paul A. Orlowski, Colebrook, CT (US)

(72) Inventor: Paul A. Orlowski, Colebrook, CT (US)

(73) Assignee: Electric Motion Company, Inc., Winsted, CT (US)

( * ) Notice: Subject to any disclaimer, the term of this patent is extended or adjusted under 35 U.S.C. 154(b) by 0 days.

(21) Appl. No.: 14/032,813

(22) Filed: Sep. 20, 2013

(65) Prior Publication Data

US 2014/0193101 A1 Jul. 10, 2014

Related U.S. Application Data

(60) Provisional application No. 61/749,590, filed on Jan. 7, 2013.

(51) Int. Cl.

| | |
|---|---|
| ***B65D 33/10*** | (2006.01) |
| ***B65D 33/16*** | (2006.01) |
| ***B65D 33/30*** | (2006.01) |
| ***E21B 27/00*** | (2006.01) |
| ***E21B 27/02*** | (2006.01) |
| ***B65D 77/30*** | (2006.01) |

(52) U.S. Cl.

CPC ..... *B65D 33/16* (2013.01); *E21B 27/02* (2013.01); *B65D 33/1658* (2013.01); *B65D 77/30* (2013.01)

(58) Field of Classification Search

CPC ..... B65D 88/1668; B65D 88/1612; B65D 33/1658; B65D 88/1681; B65D 33/20; B65F 1/12; B66C 1/226; E21B 27/02

USPC ..... 383/68, 69, 88–92, 67, 82, 83, 79, 86.1, 383/12, 13, 16, 26, 27, 30, 7; 294/68.21, 294/165; 166/162; 24/30.5 R

See application file for complete search history.

(56) References Cited

U.S. PATENT DOCUMENTS

| | | | | | |
|---|---|---|---|---|---|
| 592,602 | A | * | 10/1897 | Beecher | 383/82 |
| 681,169 | A | * | 8/1901 | Hamilton | 232/43.1 |
| 753,063 | A | * | 2/1904 | Goodridge | 383/90 |
| 1,017,721 | A | * | 2/1912 | Williams | 232/43.1 |
| 1,752,808 | A | * | 4/1930 | Reach | 383/91 |
| 1,807,819 | A | * | 6/1931 | Altgelt | 294/68.21 |
| 1,898,171 | A | * | 2/1933 | Bunnell | 224/673 |
| 3,018,880 | A | * | 1/1962 | Brugmann | 206/219 |
| 3,464,733 | A | * | 9/1969 | Shaw | 294/68.21 |
| 3,827,471 | A | * | 8/1974 | Gregory et al. | 222/181.3 |
| 3,893,595 | A | * | 7/1975 | Khanna et al. | 222/181.3 |
| 3,939,533 | A | * | 2/1976 | Benepe | 24/30.5 R |
| 5,738,443 | A | * | 4/1998 | Renaud | 383/67 |
| 5,975,759 | A | * | 11/1999 | Renaud | 383/22 |
| 6,431,753 | B1 | * | 8/2002 | Rogers et al. | 383/41 |
| 8,353,416 | B2 | * | 1/2013 | Mueller | 220/4.33 |

* cited by examiner

*Primary Examiner* — Jes F Pascua

(74) *Attorney, Agent, or Firm* — Alix, Yale & Ristas, LLP

(57) ABSTRACT

A remotely openable containment system employs a bag which receives contents such as grounding cement and employs a closure member which is secured by a bale. The closure member is attached to one end of the bag adjacent an opening. End portions of the bag are wound around the closure member and secured by the bale. The bale may include a pair of laterally spaced pins which are received in spaced bores of the closure member. At the installation site, the bag is lowered by a line into a hole. At the bottom of the hole, a line on the bale is pulled to release the bale and to permit the contents to discharge through the opening in the bag. Both the bag and the bale are removable from the hole by the attached lines.

20 Claims, 7 Drawing Sheets

REMOTELY OPENABLE CONTAINMENT SYSTEM AND INSTALLATION METHOD

BACKGROUND

This disclosure relates generally to the usage of grounding cement for power tower installations. More particularly, this disclosure relates to products and techniques for installing grounding cement in an augured hole.

Power is commonly transmitted through overhead power transmission lines which are supported by spaced poles. For some applications, the poles are formed from composite materials. A hole is formed by an auger. The pole is inserted into the hole and disposed in an upright orientation. A ground wire is strung from the top of the pole and extends into the hole. Grounding cement, which comprises Portland cement and carbon materials, is dropped into the bottom of the hole to enhance the grounding.

In conventional installation techniques, the grounding cement arrives at the installation site in bags. The bags are typically opened at ground level and the cement is poured into the augured hole. Grounding cement is ordinarily not mixed with water to form a slurry, but can set over time upon exposure to moisture.

Upon opening the bag, the grounding cement typically emits a cloud-like dust emission which can be hazardous. Installers are typically required to use masks and to cover their skin to prevent exposure to the dust and to prevent migration of the dust into the installers' respiratory systems. Nevertheless, in practice despite known safety hazards and occupational safety requirements, the grounding cement is often handled without the appropriate use of masks and other protective apparel.

In addition, it is common that the hole collects water at the bottom between the time the hole is formed and the time to install the pole. Consequently, the grounding cement actually may not fully descend to the bottom of the hole in its entirely, and consequently, may not provide the optimum grounding function.

SUMMARY

Briefly stated, a remotely openable containment system comprises a bag having a first end portion with a handle and an opposed second end portion defining a closeable opening. Material is disposed in the bag. A closure member is attached to the bag. The closure member has retainers, such as laterally opposed bores. The second end portion of the bag is engaged about the closure member to close the opening. A bale comprises a frame with a pair of laterally spaced pins. Each of the pins is received in a corresponding retainer or bore of the closure member. The frame is engageable against the bag to rotatably fix the closure member and contain the material within the bag.

The bale is removed from the closure bores. When the bag is vertically lifted by the handle, the material is discharged through the opening. The material is grounding cement in one embodiment. The closure member is preferably a tube. The closure member is rotatably attached to the bag by an adhesive strip.

The bale is preferably formed from wire and has a handle. The closure member is attached to the bag by a pair of laterally spaced loops. The pins each have a terminal end which extends beyond the bale bores and is bent over the closure member.

A remotely openable containment system comprises a bag having a first end portion with a handle and an opposed second end portion defining a closeable opening. Material is disposed in the bag. A closure member is attached to the bag. The second end portion of the bag is engaged about the closure member to close the opening. A bale is releasably engageable with the closure member to fixably position the closure member and contain the material within the bag.

When the bale is released from the closure member and the bale is vertically lifted by the handle, the material is discharged through the opening. The closure member is preferably an elongated tube and the second end portion of the bag is wound about the closure member.

A method of remotely opening a bag with a material comprises providing a bag having a handle at one end and a closure member at an opposite end closing an opening in the bag and being secured in a closed position by a bale. The method further comprises attaching a line to the bag handle and attaching a line to the bale. The bag is lowered by the first line until the bag reaches a desired position. The method further comprises pulling on the second line to release the bale from the closure member to thereby allow the material to discharge through the opening. The first line is pulled to retrieve the bag from the location. The second line is pulled to retrieve the bale from the opening. The position is preferably at a bottom end of a hole.

The method is preferably employed for applications wherein the material is grounding cement. The bale has a handle and further comprising attaching a second line to the handle. The bale further engages laterally opposed portions of the closure member and the method comprises pulling the second line to release opposed portions of the closure member. The method also preferably comprises removing end portions of the bale.

DETAILED DESCRIPTION

Figure 4:
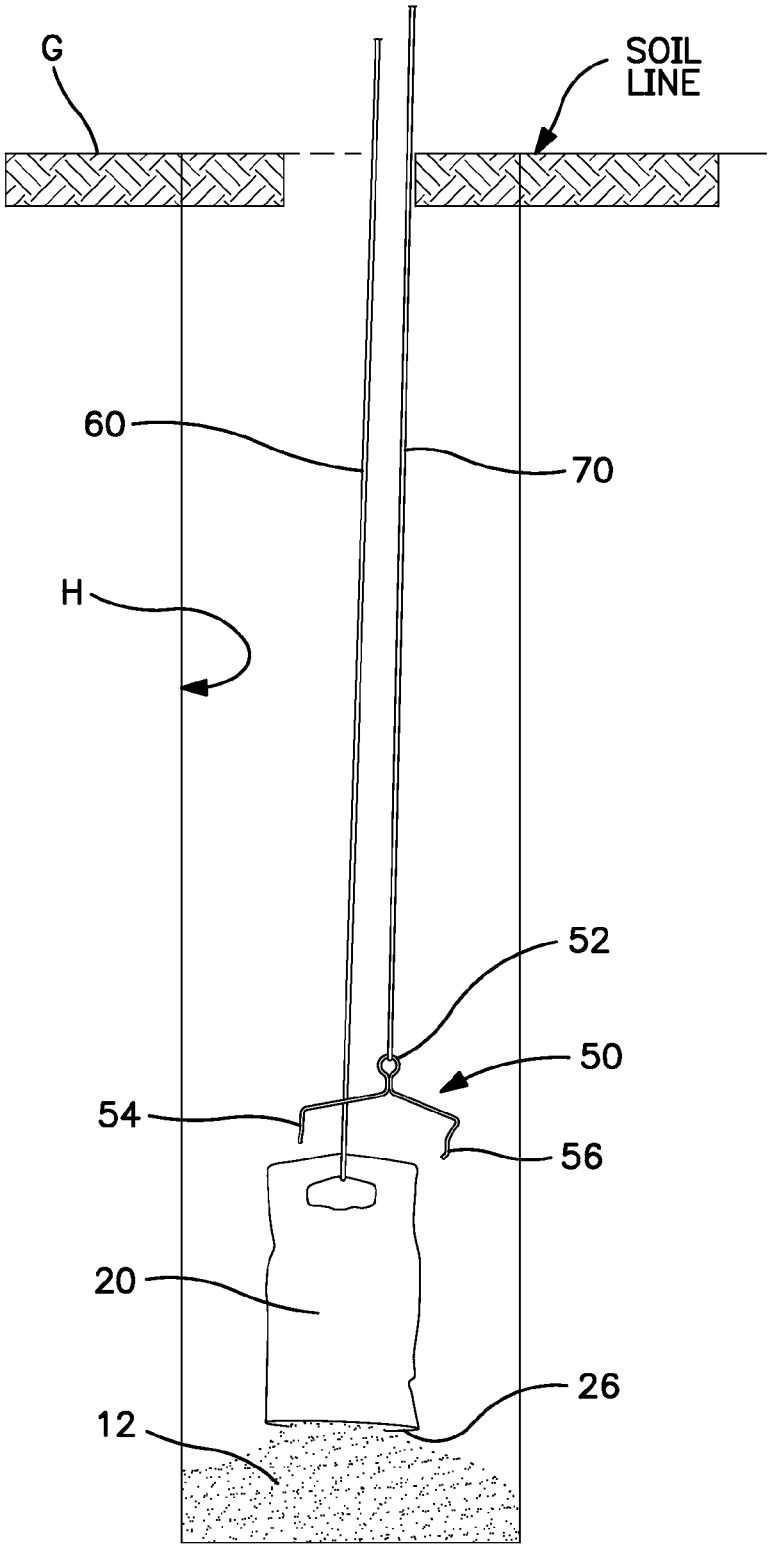
FIG. 4 is a sectional view of the augured installation hole and the bag of FIG. 3, wherein the bag has been remotely opened to show the contents deposited at the bottom of the installation hole.
Figure 6:
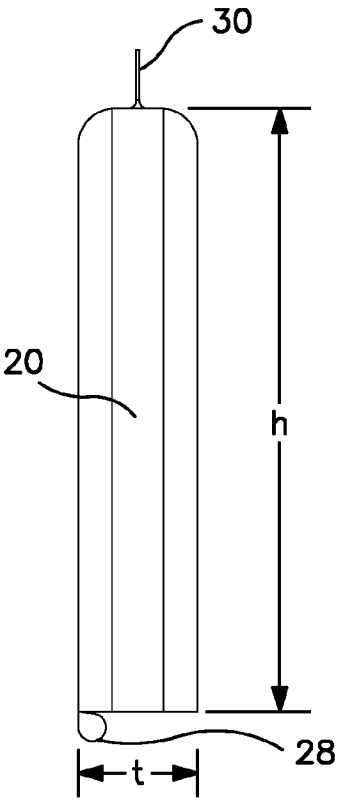
FIG. 6 is a side elevational view of the bag of FIG. 5.
Figure 5:
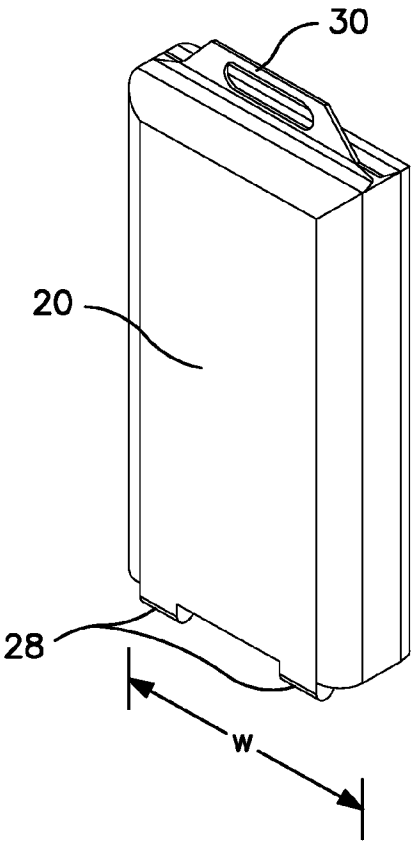
FIG. 5 is an upright perspective view of the bag of FIG. 1 in a pre-deployed state.
Figure 8:
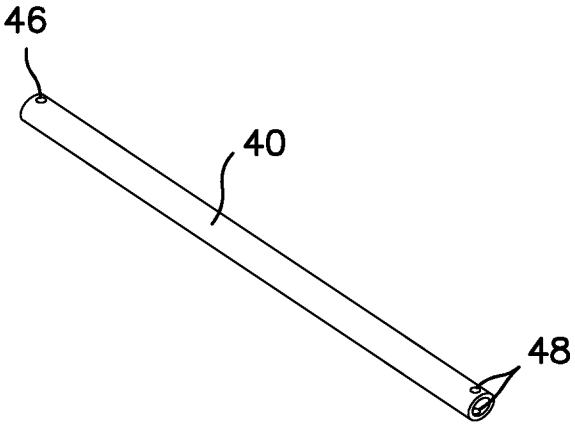
FIG. 8 is a perspective view of a closure member employed in the bag of FIG. 1.

With reference to the drawings, wherein like numerals represent like parts throughout the Figures, a remotely openable bag is generally designated by the numeral 10. The bag 10 is configured so that it may securely contain a heavy, dense material which, for the preferred application, is grounding cement 12 (FIG. 4). The filled bag may be transported to an installation site and placed in a proper position wherein it can be opened and used by an installer from a location remote from the bag. In one embodiment (FIGS. 5 and 6), the filled bag 10 has a nominal height of 23.25 ins., a nominal width w of 12.00 ins. and a nominal thickness t of 4.50 ins.

The bag 10 has a rugged heavy-duty construction and, in one embodiment, is constructed of multiple layers. The layers are generally flexible before filling. The bag 10 is an elongated sleeve-like member 20 which, at one end or a top end 22, has a handle 30. The handle 30 is preferably formed by an oblong opening through opposed engaged sides of the top portion of the bag. The handle may have other configurations.

In an opened condition, the lower portion or opposed second end portion 24 of the bag forms a laterally extending opening 26. The contents for the bag are typically inserted through the opening to fill the bag.

An elongated closure member 40, which is preferably a plastic tube, is attached to one side of the bag proximate the opening 26. A pair of laterally spaced loops 28 extends to closely receive the closure member 40. The loops 28 may be stitched in place. An adhesive strip 42 is optionally used to engage the closure member and the bag to rotatably fix the closure member relative to the bag. Other attachment structures are also possible. The closure member includes laterally spaced generally parallel retainer bores 46 and 48. The end of the bag is wrapped around the closure member to close the opening 26. The closure member 40 is secured in a fixed position closing the opening by a bale 50.

Figure 9:
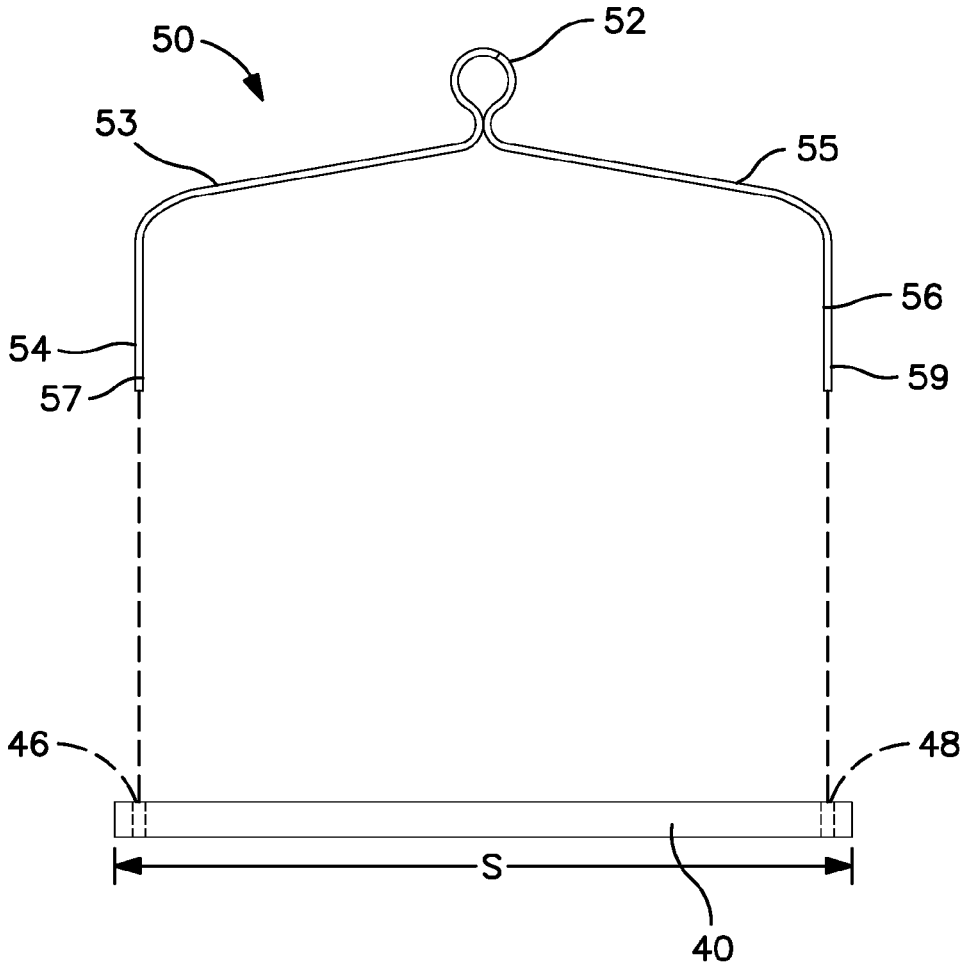
FIG. 9 is a composite diagrammatic view of the closure member and bale of FIGS. 7 and 8.

The bale 50, which preferably has a wire construction, may be formed from a relatively stiff, bendable wire member. The wire member is bent to form a central handle 52. The handle shape is reinforced by a spot weld or twists. The wire hook piece is laterally and forwardly folded in compound bends in a pair of shoulders 53 and 55 which downwardly terminate to form a pair of laterally spaced retainer pins 54 and 56, respectively. With additional reference to FIG. 9, the spacings between the pins 54 and 56 is generally commensurate with the spacing between the bores 46 and 48 of the closure member 40.

Figure 7:
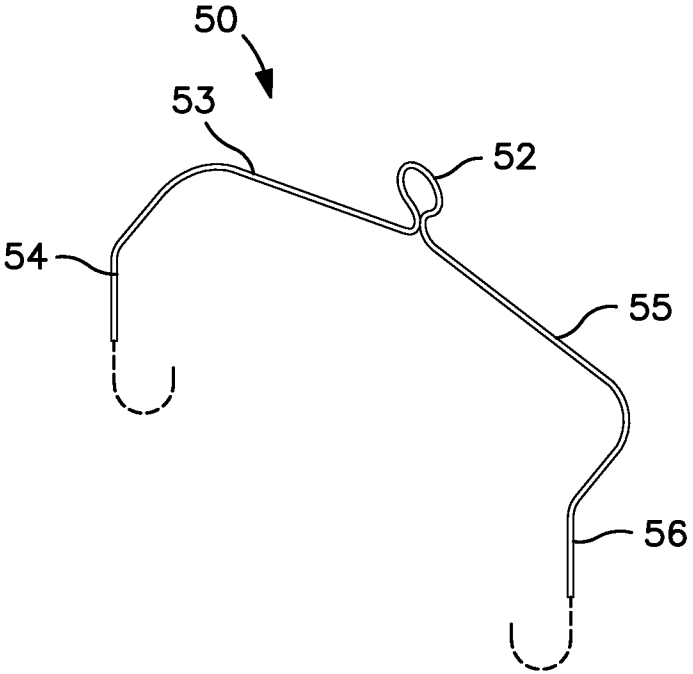
FIG. 7 is a perspective view of a bale member employed in the bag of FIG. 1.

The end portions of the bag are wound around the closure member 40 to close the opening 26. Once the closure member is positioned to close the opening 26, the pins 54 and 56 are inserted into the respective bores 46 and 48. The terminal ends 57 and 59 of the respective pins 54 and 56 are preferably bent over to reinforce the bale/closure member engagement. A bent configuration is represented by broken lines in FIG. 7. The bale 50, including the shoulders 53 and 55, resiliently engages against the side of the filled bag so that the closure member 40 is essentially captured in a fixed rotatable position. It will be appreciated that in the fixed position, the closure member 40 closes off the opening 26 with a high degree of containment integrity. Alternatively, the closure member may have retainers other than bores for receiving the pins 54 and 56 of the bale 50.

Multiple bags 10 with the contained material are suitable for stacking. The bag 10 with its bulky contained material 12 can be transported without jeopardizing the containment integrity of the bag and the closure member 40.

Figure 1:
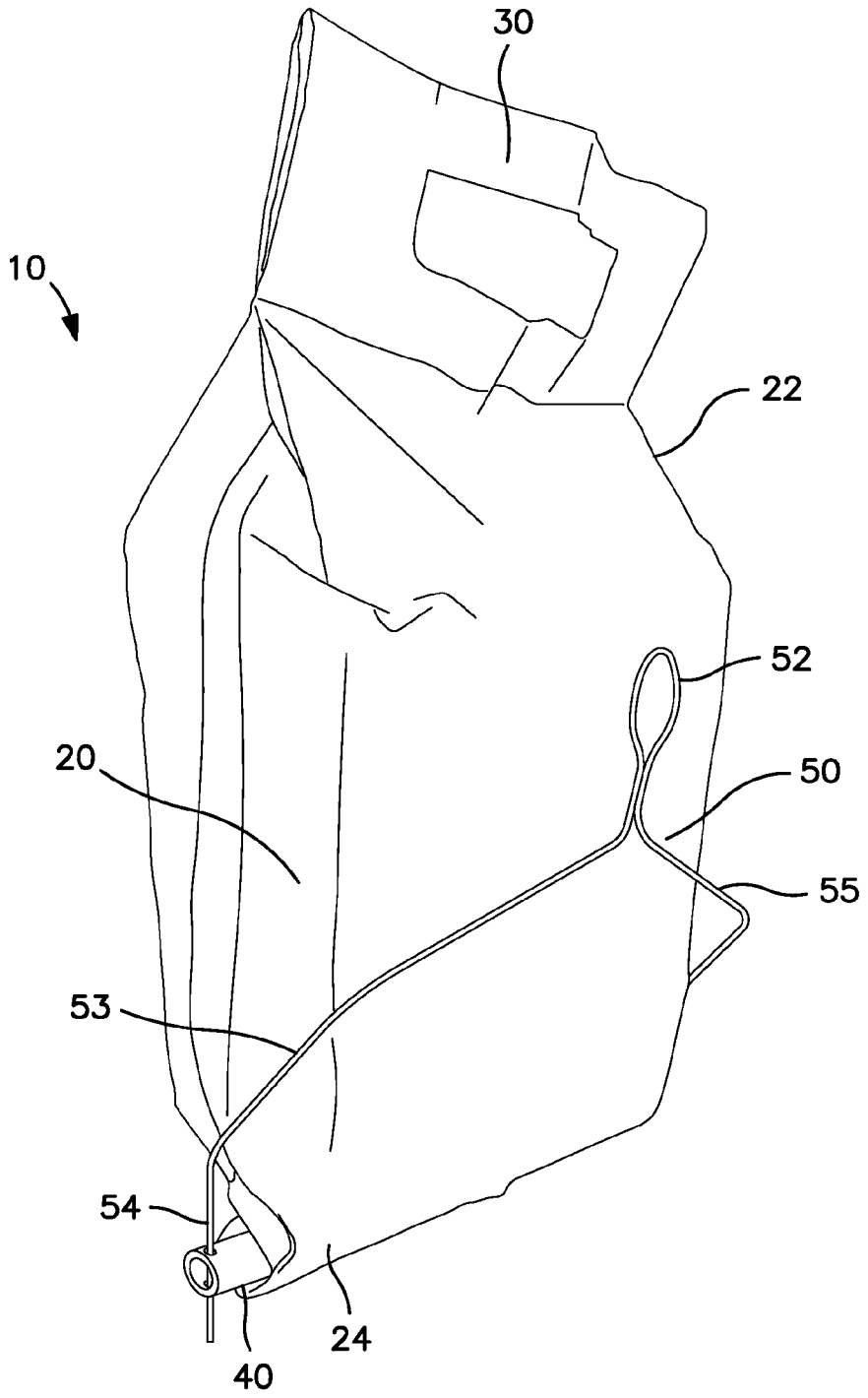
FIG. 1 is a perspective view of a remotely openable bag.
Figure 2:
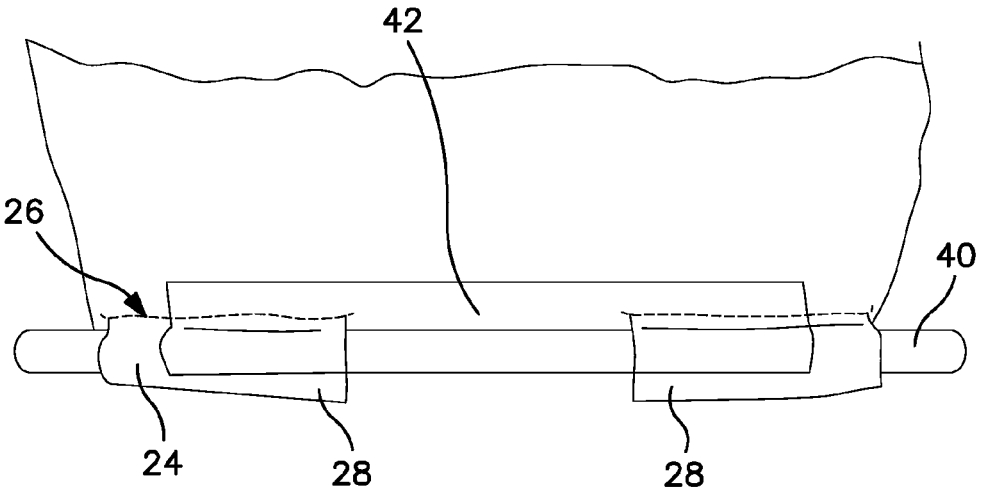
FIG. 2 is an enlarged view showing a portion of a closure member and a lower portion of the bag.
Figure 3:
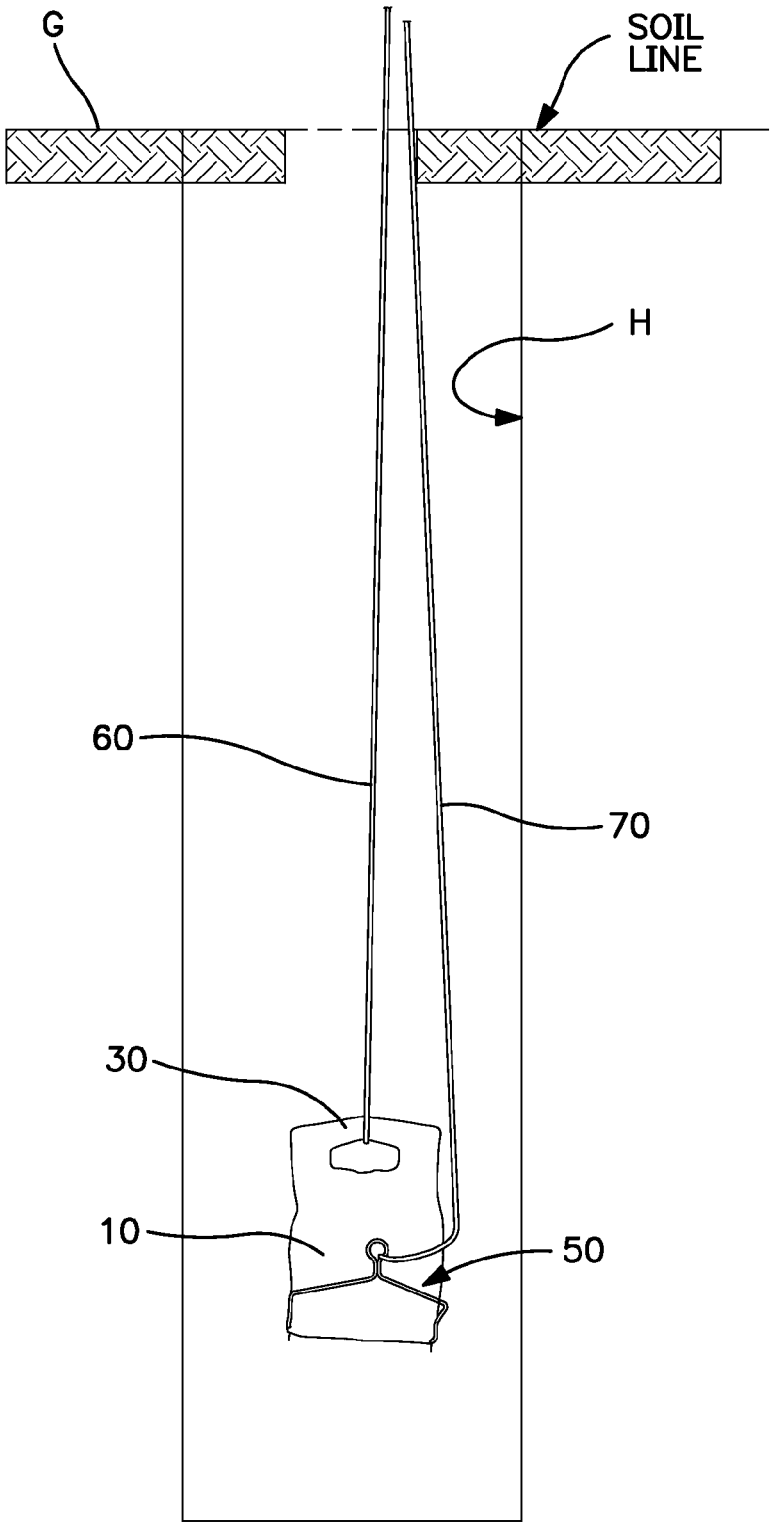
FIG. 3 is a side sectional view of an augured installation hole and the remote openable bag of FIG. 1 attached to a pair of lines wherein the bag is lowered into the bottom portion of the hole below the water line.

With additional reference to FIGS. 3 and 4, the bag 10 with the filled contents is ultimately transported to a worksite. A preferred usage for the bag 10 is the containment of ground cement to be discharged in a hole H formed by an auger for installation of a power tower (not illustrated). A rope or line 60 is attached to the handle 30. A second line 70 for releasing the bale 50 is attached to the handle 52 of the bale. If the ends 57 and 59 are folded over, they are removed, preferably by snipping the wire material. The bale 50 is essentially primed for release from the closure member 40. The pins 54 and 56 are now generally linear in configuration and traverse through the bores 44 and 46 of the closure member.

The bag 10 is then lowered into the augured hole H with the aid of line 60. The force engendered by the weight of the contents is exerted on the line 60. If the hole has water in the bottom, the bag descends through the water to the bottom of the hole. The lines 60 and 70 are preferably color coded or otherwise differentiated to aid in the proper sequence of lowering, then opening the bags.

The line 70 is then pulled by the installer who stands on the ground G adjacent the hole H to pull the bale 50 from the closure member 40. The closure member 40 is now free to angularly rotate, and thus the weight of the grounding cement 12 against the lower portions of the bag unravels the wound closure configuration and will force the bag open. The grounding cement 12 (or other contents) is then released through the opening 26 at the bottom of the hole. If there is water in the hole, then the dust emissions will be damped or immediately submersed in the water.

Both the bag 10 and the bale 50 can be retrieved from the hole by respectively pulling on the lines 60 and 70. Consequently, nothing will be left in the hole except for the cement.

It will also be appreciated that the bag 10 is typically opened below the water level or at the bottom of the hole, and consequently, any hazardous dust released from the bag will be confined under the water and/or at the very bottom of the hole. The opening of the bag is thus very likely to not result in any hazardous exposure to the installer. In addition, the system is environmentally friendly since the empty bag 10 and all the associated hardware (including bale 50) is retrieved from the hole for safe disposal.

While preferred embodiments of the invention have been set forth for purposes of description, the foregoing should not be deemed a limitation of the invention herein. Accordingly, various modifications, adaptations and alternatives may occur to one skilled in the art without departing from the spirit and the scope of the invention.

The invention claimed is:

1. A remotely openable containment system comprising:

a bag having a first end portion with a handle and an opposed second end portion defining a closable opening;

material disposed in said bag;

a tube attached to said bag, said tube having laterally opposed bores, the second end portion of said bag being engaged about said tube to close said opening; and a bale comprising a frame with a pair of laterally spaced pins, each received in a corresponding bore of said tube, and said frame engageable against bag to rotatably fix said tube and contain said material within said bag.

2. The containment system of claim 1 wherein when said bale is removed from said bores and said bag is lifted vertically by said handle, said material is discharged through said opening.

3. The containment system of claim 1 wherein said material is grounding cement.

4. The containment system of claim 1 wherein said bale is formed from wire.

5. The containment system of claim 1 wherein said bale has a handle.

6. The containment system of claim 1 wherein said pins each have a terminal end which extends beyond the tube bores and is bent over.

7. A remotely openable containment system comprising:

a bag having a first end portion and an opposed second end portion defining a closable opening;

material disposed in said bag;

a closure member attached to said bag, said closure member comprising an elongated tube having a pair of laterally spaced bores, the second end portion of said bag being engaged about said closure member to close said opening; and a bale releasably engageable with said closure member and extending through said bores to fixably position said closure member and contain said material within said bag.

8. The containment system of claim 7 further comprising a handle connecting said first end portion and wherein when said bale is released from said closure member and said bag is lifted vertically by said handle, said material is discharged through said opening.

9. The containment system of claim 7 wherein the second end portion of said bag is wound about said closure member.

10. The remotely openable containment system of claim 7 wherein said material is grounding cement.

11. The remotely openable containment system of claim 7 wherein said closure member is attached to said bag by a pair of laterally spaced loops.

12. A remotely openable containment system comprising:

a bag having a first end portion with a handle and an opposed second end portion defining a closable opening;

grounding cement disposed in said bag;

a closure member attached to said bag having laterally opposed retainers, the second end portion of said bag being engaged about said closure member to close said opening; and a bale comprising a frame with a pair of laterally spaced pins, each received in a corresponding retainer of said closure member, and said frame engageable against bag to rotatably fix said closure member and contain said grounding cement within said bag.

13. The containment system of claim 12 wherein said closure member is a tube and said retainers are bores.

14. The containment system of claim 12 wherein said closure member is rotatably attached to said bag by an adhesive strip.

15. The containment system of claim 12 wherein said closure member is attached to said bag by a pair of laterally spaced loops.

16. A remotely openable containment system comprising:

a bag having a first end portion with a handle and an opposed second end portion defining a closable opening;

material disposed in said bag;

a closure member attached to said bag by a pair of laterally spaced loops and having laterally opposed retainers, the second end portion of said bag being engaged about said closure member to close said opening; and a bale comprising a frame with a pair of laterally spaced pins, each received in a corresponding retainer of said closure member, and said frame engageable against bag to rotatably fix said closure member and contain said material within said bag.

17. The containment system of claim 16 wherein said material is grounding cement.

18. The containment system of claim 16 wherein said closure member is a tube and said retainers are bores.

19. The containment system of claim 18 wherein said pins each have a terminal end which extends beyond the bores and is bent over.

20. The containment system of claim 16 wherein said bale is formed from wire and said bale has a handle.

* * * * *